US009206585B2

(12) United States Patent
Kurushima

(10) Patent No.: US 9,206,585 B2
(45) Date of Patent: Dec. 8, 2015

(54) WORKING MACHINE HAVING CONSOLE BOX

(71) Applicant: KOBELCO CONSTRUCTION MACHINERY CO., LTD., Hiroshima-shi (JP)

(72) Inventor: Satoshi Kurushima, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 0 days.

(21) Appl. No.: 14/491,031

(22) Filed: Sep. 19, 2014

(65) Prior Publication Data

US 2015/0115659 A1 Apr. 30, 2015

(30) Foreign Application Priority Data

Oct. 30, 2013 (JP) ..... 2013-225403

(51) Int. Cl.

| | |
|---|---|
| ***E02F 9/00*** | (2006.01) |
| ***E02F 9/16*** | (2006.01) |
| ***E02F 9/22*** | (2006.01) |
| ***E02F 3/32*** | (2006.01) |

(52) U.S. Cl.

CPC . *E02F 9/16* (2013.01); *E02F 3/325* (2013.01); *E02F 9/2275* (2013.01)

(58) Field of Classification Search

CPC ..... E02F 9/16; E02F 9/2275; E02F 3/325
USPC ..... 296/190.01, 190.08, 63; 180/315, 326, 180/89.12

See application file for complete search history.

(56) References Cited

U.S. PATENT DOCUMENTS

| | | | | |
|---|---|---|---|---|
| 6,352,133 | B1 * | 3/2002 | Ojima | 180/326 |
| 6,450,278 | B1 | 9/2002 | Shirogami et al. | |
| 7,014,255 | B2 * | 3/2006 | Amamiya et al. | 296/190.08 |
| 7,290,635 | B2 * | 11/2007 | Bisick et al. | 180/272 |
| 8,464,828 | B2 * | 6/2013 | Takeda et al. | 180/326 |
| 2012/0104798 | A1 | 5/2012 | Takeda et al. | |

FOREIGN PATENT DOCUMENTS

| | | |
|---|---|---|
| EP | 1 074 665 A1 | 2/2001 |
| JP | 2010-90589 A | 4/2010 |
| JP | 2012-92611 | 5/2012 |

OTHER PUBLICATIONS

Extended European Search Report issued Mar. 17, 2015 in Patent Application No. 14186519.6.

* cited by examiner

*Primary Examiner* — Joseph D Pape
(74) *Attorney, Agent, or Firm* — Oblon, McClelland, Maier & Neustadt, L.L.P.

(57) ABSTRACT

Provided is a working machine capable of preventing excessive force from being exerted on a hydraulic hose connected to a console box by movement of the console box. The working machine includes a machine body including an operation space on a floor surface, a seat stand in the operation space and including a side wall portion defining an accommodation space, an operator's seat, a console box capable of moving between a fall-down position and an upturn position, and a hydraulic hose including an over-floor region extending upward from the floor surface to be connected to a front part of the console box and accommodated in the accommodation space so as to have a curved portion. The side wall portion has an oblique guide surface which guides the curved portion to make the curved portion slide along the oblique guide surface by turning of the console box.

4 Claims, 7 Drawing Sheets

WORKING MACHINE HAVING CONSOLE BOX

TECHNICAL FIELD

The present invention relates to a working machine such as a hydraulic excavator including a so-called upturn type of console box.

BACKGROUND ART

There is known a working machine such as a hydraulic excavator or the like, the working machine including a working device, an operator's seat, and console boxes as respective operation devices disposed on the right and left sides of the operator's seat. Each of the console boxes includes an operation lever for operating the working device, and a pilot valve configured to output a pilot pressure corresponding to the operation applied to the operation lever. To the pilot valve, connected are a plurality of hydraulic hoses routed from a device room and raised from a floor surface below the console box.

In some small-sized machines, there can be cases where a specific console box which is one of the right and left console boxes and located on an entrance side is designed as a so-called upturn type of console box. For example, the console box described in Japanese Patent Application Laid-open No. 2012-92611 has a gate lever, which usually protrudes forward so as to block an entrance path but can be rearward upturned when an operator lifts up the gate lever to pivot it rearward, the operation lever thus opening the entrance route to allow the operator to easily get on and off the working machine.

This console box, however, involves the following important problem on handling of the hydraulic hose when the gate lever is upturned. The hydraulic hose is given a deflection in advance in anticipation of the tension in the hydraulic hose involved by the upturn of the console box, to which the hydraulic hose is connected. The hydraulic hose is, thus, deflected and extended in accordance with the movement of the console box. Hence, there is generally secured a movement-allowance space around the hydraulic hose for allowing the hydraulic hose to be moved with no problem. However, integration of equipment is recently required for downsizing the work machine, which makes it difficult to secure the movement-allowance space. There exist cases where contact of the hydraulic hose with its surrounding structure is inevitable, depending on the type of the working machine, and the contact may involve promotion of deformation of the hydraulic hose or reduction in durability thereof.

SUMMARY OF INVENTION

An object of the present invention is to provide a working machine including a so-called upturn type of console box and a hydraulic hose connected to the console box, the working machine being capable of effectively preventing excessive force from being exerted on the hydraulic hose involved by the movement of the console box, within a space limitation. Provided by the present invention is a working machine comprising: a base carrier; a machine body mounted on the base carrier, the machine body including a working device configured to make a working movement according to an operation, a device room accommodating a device for hydraulic control of the working device, a flooring forming a floor surface, and an operation space defined on the floor surface to allow the operation on the working device to be performed in the operation space; a seat stand provided in the operation space and including a side wall portion defining a hose accommodation space; an operator's seat supported by the seat stand at a position higher than the floor surface; a console box supported by the seat stand at a position higher than the floor surface and alongside the operator's seat, the console box having a rear part coupled to the seat stand so as to be capable of being turned to allow the console box to be moved between a fall-down position at which the console box blocks an entrance route lateral to the operator's seat and an upturn position at which a front part of the console box is upturned so as to open the entrance route; and a hydraulic hose including an over-floor region which extends upward from the floor surface to be connected to the front part of the console box, the over-floor region of the hydraulic hose being accommodated in the hose accommodation space so as to be rearward curved with a curvature which is increased with a movement of the console box from the fall-down position to the upturn position. The side wall portion of the seat stand has an oblique guide surface which is laterally oblique relatively to a plane orthogonal to an axis of the turning of the console box, and the oblique guide surface guides a curved portion of the over-floor region of the hydraulic hose so as to make the curved portion slide laterally along the oblique guide surface by the turning of the console box.

Figure 7B:
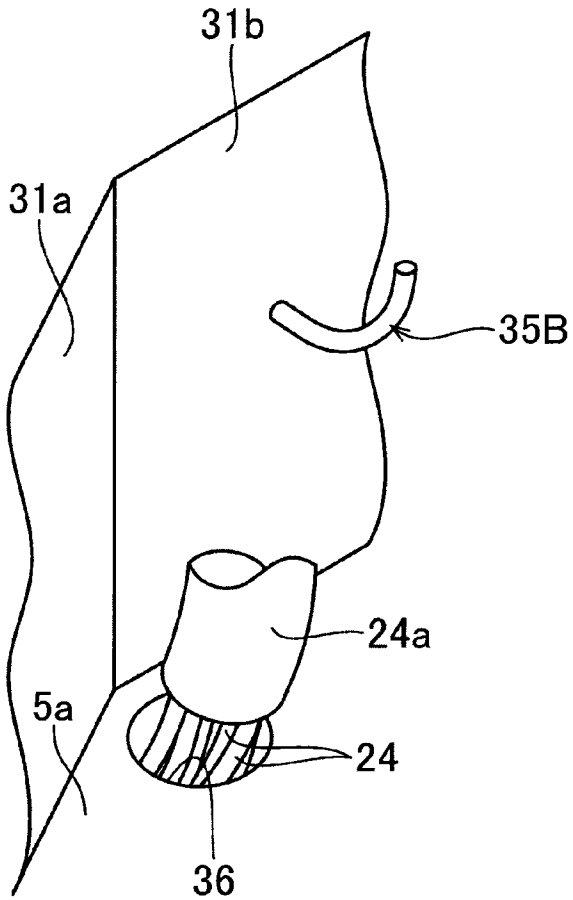
Figure 7A:
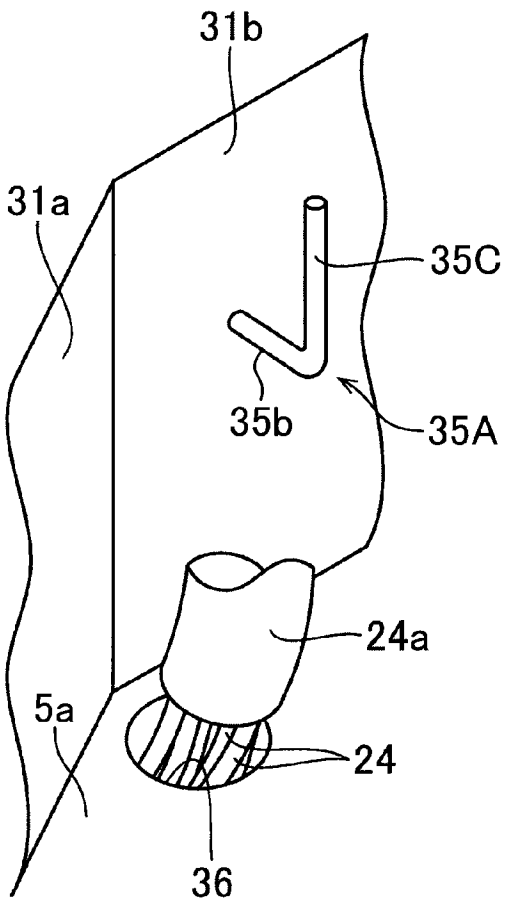

Each of FIGS. 7A and 7B is a perspective view showing a modification of a guide member.

DESCRIPTION OF EMBODIMENTS

Below will be specifically described an embodiment of the present invention based on the drawings. It should be noted that the following description is just exemplary in nature and not intended to limit the present invention, its application, or its use.

Figure 1:
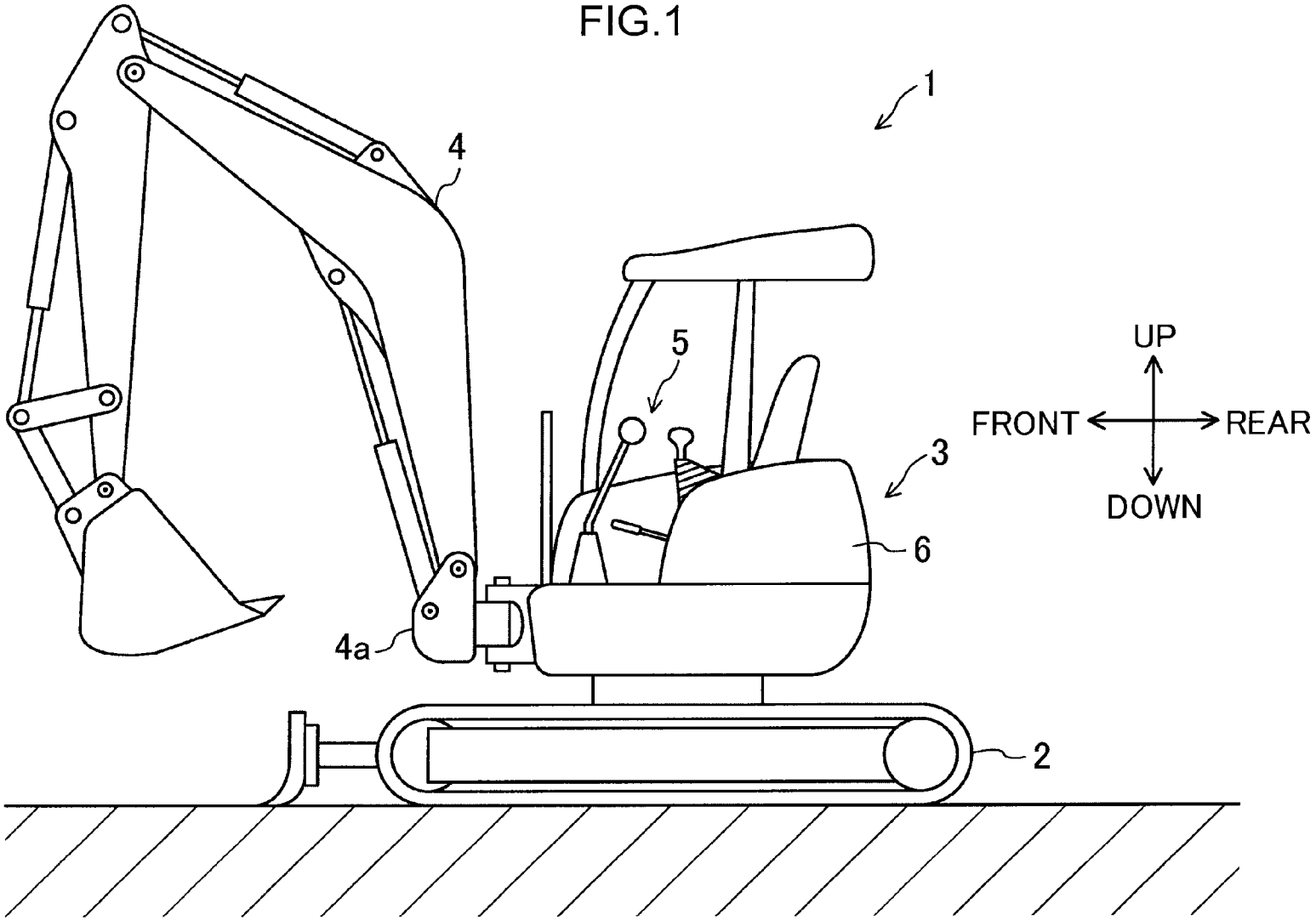
FIG. 1 is a side view showing a hydraulic excavator according to an embodiment of the present invention.

FIG. 1 shows a hydraulic excavator 1 as an example of a working machine according to the present invention. The hydraulic excavator 1 according to this embodiment is a small-sized working machine having a machine mass of 5 t or less, namely, a so-called compact excavator. The hydraulic excavator 1 includes a base carrier 2 having a pair of crawlers which allows the base carrier 2 to make flexible travelling, and a machine body 3 mounted on the base carrier 2 so as to be slewable. The machine body 3 includes an attachment 4, an operation space 5, a flooring 7, and a device room 6. The attachment 4 is at the front part of the machine body 3, and the device room 6 is at the rear part of the machine body 3. The operation space 5 is located forward of the device room 6 and at substantially the center of the machine body 3. The flooring 7 in the embodiment is formed of a horizontal plate member and located below the operation space 5, having an upper surface forming a floor surface 5*a* of the operation space 5.

Note that directions such as up, down, left, and right in the following description are determined with respect to the machine body 3, as indicated by respective arrows in each drawing.

The attachment 4 is a working device configured to perform a working movement according to an operation by an operator. The attachment 4 includes a boom, an arm, and a bucket, respective movements thereof being hydraulically controlled. The attachment 4 according to the embodiment is supported by a swing bracket 4*a* and allowed to be swung integrally with the swing bracket 4*a* in right and left directions relatively to the other parts of the machine body 3.

The device room 6 accommodates various hydraulic devices for hydraulic control of the attachment 4 and an engine, which are not shown in the drawing. In the operation space 5, the operator is allowed to perform the operation on the attachment 4 and the control of the hydraulic excavator 1. In the embodiment, the operation space 5 is opened to the surroundings thereof, wherein an entrance is formed on the left side of the operation space 5.

Figure 2:
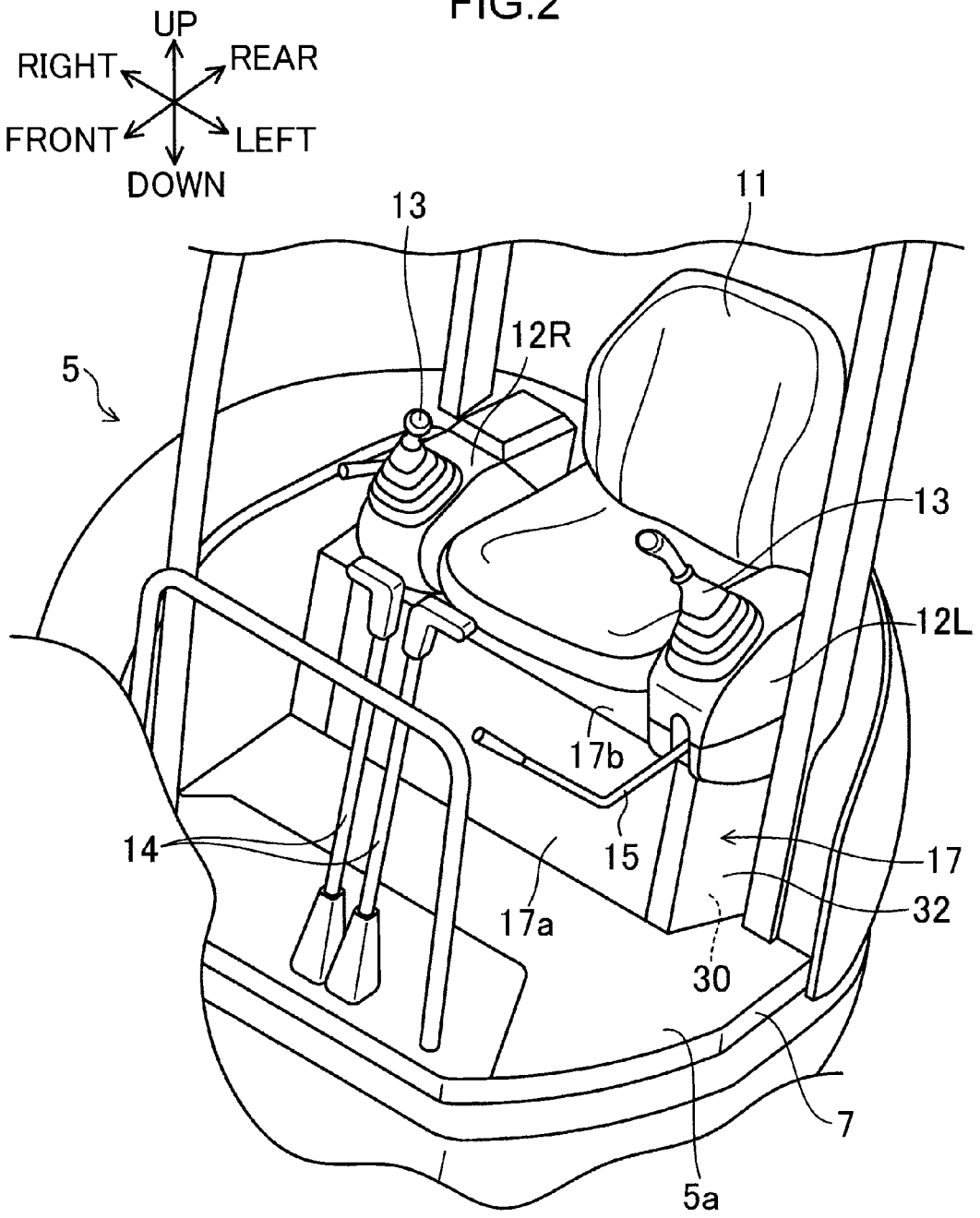
FIG. 2 is a perspective view of an operation space defined in the hydraulic excavator.

FIG. 2 shows a plurality of components installed in the operation space 5. The hydraulic excavator further includes, as respective components, an operator's seat 11, right and left console boxes 12R, 12L provided on respective right and left sides of the operator's seat 11, a pair of travelling levers 14, and a seat stand 17.

The floor surface 5*a* formed by the flooring 7 is spread under the front part of the operation space 5, and the seat stand 17 is provided in the rear part of the operation space 5.

The seat stand 17 includes a front wall portion 17*a*, a support wall portion 17*b*, and a side wall portion 31. The front wall portion 17*a* stands upright on the flooring 7 and is spread in the right and left directions, i.e., in a width direction, to face the front side. The support wall portion 17*b* extends rearward from the upper end of the front wall portion 17*a* and supports the operator's seat 11 and the right and left console boxes 12R and 12L on the support wall portion 17*b*. The operator's seat 11 and the right and left console boxes 12R and 12L are supported at respective positions on the support wall portion 17*b* higher than the floor surface 5*a*, so as to allow the operator to easily perform seating in the operator's seat 11 and manipulating the console boxes 12R and 12L.

Figure 3:
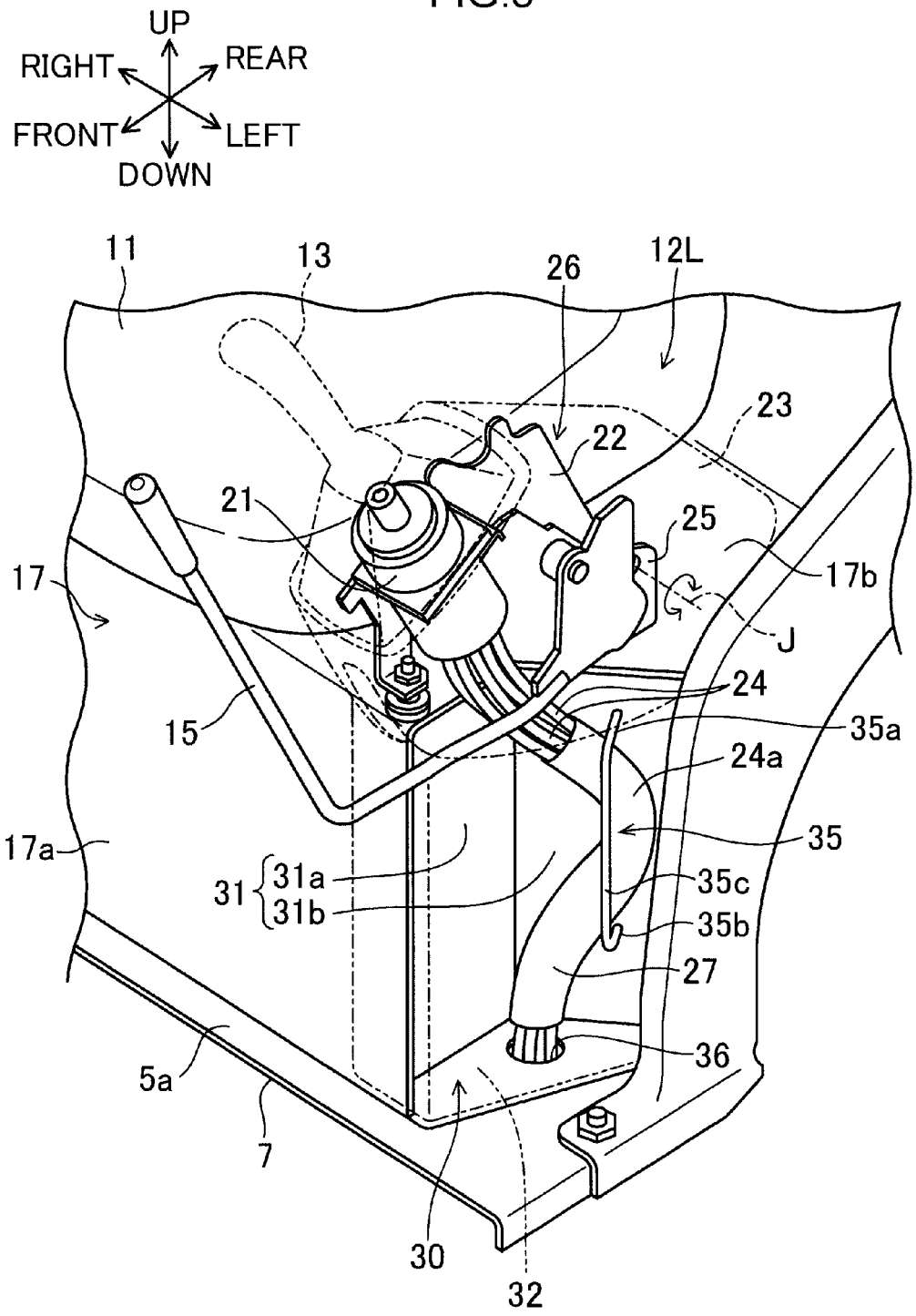
FIG. 3 is a perspective view showing the internal structure of an upturn type of console box provided in the hydraulic excavator and the structure around the console box.

Each of the right and left console boxes 12R and 12L is an operation device and is long in front and rear directions. Out of the console boxes 12R and 12L, the console box on the entrance side, namely, the left console box 12L in the embodiment, is a so-called upturn type of console box. As shown in FIG. 3, the left console box 12L includes an operation lever 13, a pilot valve 21 which is a device for hydraulic control, a frame structure 22, an upturn lever 15, and a console cover 23.

The console cover 23 is shaped as a box, disposed around the pilot valve 21 and the frame structure 22 to cover them. The operation lever 13 is installed to the console cover 23 while being coupled to the pilot valve 21.

The frame structure 22 has a rear end part supported by the seat stand 17. Specifically, the support wall portion 17*b* of the seat stand 17*a* is attached with a bracket 25, which supports the rear end part of the frame structure 22 so as to allow the frame structure 22 to be turned about a lateral axis J extending in the right and left directions. The upturn lever 15 is attached to the left side part of the frame structure 22, having a front part which greatly protrudes forward beyond the console cover 23. The pilot valve 21 has a substantially cylindrical shape and is attached to the upper part of the front end of the frame structure 22 in a forward leaning posture.

Figure 6B:
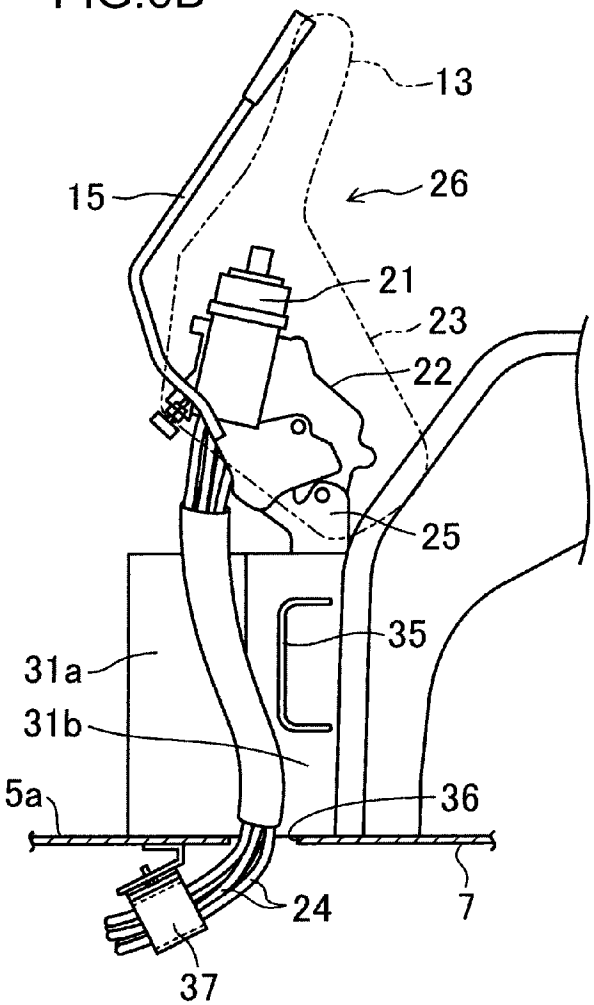
FIG. 6B is a side view showing the console box at an upturn position.
Figure 6A:
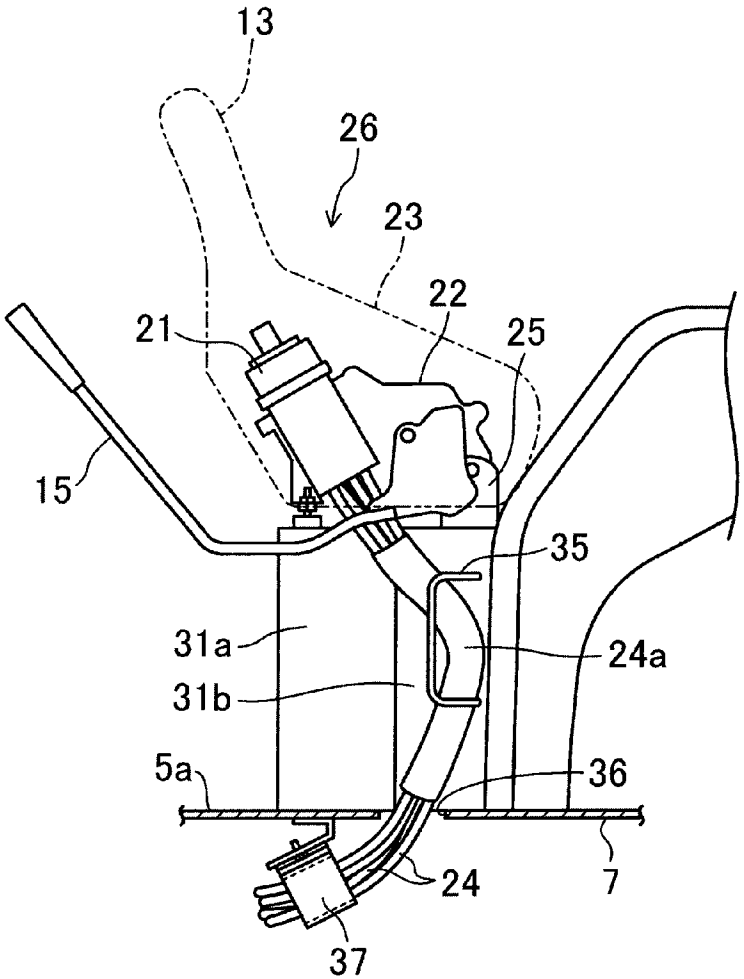
FIG. 6A is a side view of showing the console box at a fall-down position.

The frame structure 22, the pilot valve 21, the operation lever 13, the upturn lever 15, and the console cover 23 described above are able to be integrally upturned. Specifically, the left console box 12L is able to be turned between a fall-down position at which the upturn lever 15 blocks the entrance route as shown in FIGS. 2, 3, and 6A and an upturn position at which the left console box 12L is raised so as to direct the front part thereof upward (including obliquely upward) to open the entrance route as shown in FIG. 6B: the operator can move the console box 12L from the fall-down position to the upturn position, that is, can upturn the console box 12L, by performing an upturn operation which is an operation of lifting up the upturn lever 15 of the left console box 12L at the fall-down position to turn the upturn lever 15 rearward. The left console box 12L thus upturned to the upturn position opens the entrance route to thereby allow an operator to get in and get out of the operation space 5 easily.

This hydraulic excavator further includes a group of hydraulic hoses constituted of a plurality of hydraulic hoses 24. The group of hydraulic hoses includes an over-floor region, which is routed so as to interconnect the hydraulic control device in the device room 6 and the pilot valve 21. The over-floor region extends upward from the floor surface 5*a* to be connected to the lower end part of the pilot valve 21 in the forward leaning posture in the front part of the left console box 12L at the fall-down position as shown in FIG. 6A.

The group of hydraulic hoses is attached with a protective cover 27, which bundles the plurality of hoses 24 included in the group of hydraulic hoses. A specific part of the group of hydraulic hoses, to which part the protective cover 27 is attached, includes a curved portion 24*a* which is deflected rearward to be curved when the left console box 12L is at the fall-down position as shown in FIG. 6A. Since the group of hydraulic hoses is pulled upward when the left console box 12L is at the upturn position, the curved portion 24*a* is curved more significantly, i.e., with a greater curvature, when the left console box 12L is at the fall-down position than that when the left console box 12L is at the upturn position.

Figure 4A:
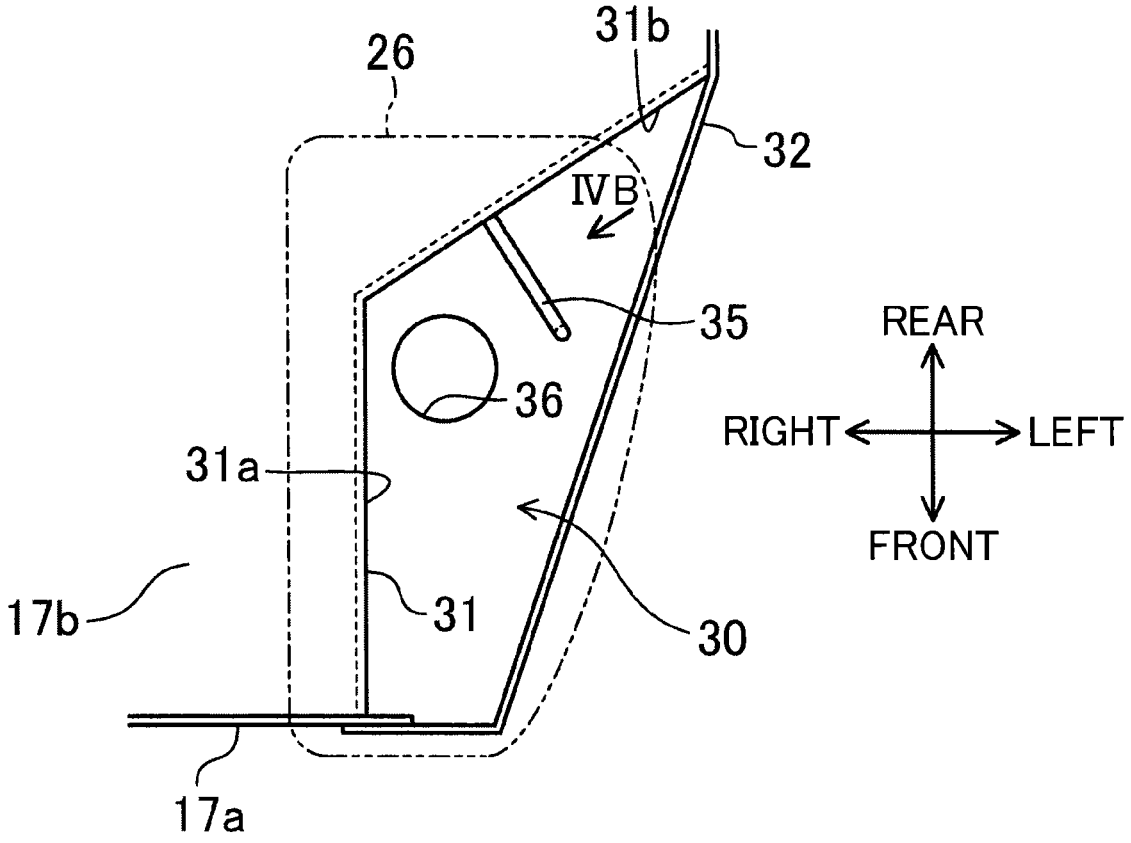
FIG. 4A is a plan view showing a part of a seat stand provided in the hydraulic excavator, the part defining a hose accommodation space.

The seat stand 17 defines an accommodation space 30 which is a hose accommodation space for accommodating the over-floor region of the group of hydraulic hoses so as to conceal the over-floor region from the outside. As shown in FIG. 4A, the accommodation space 30 is an oblong tubular space positioned below the left console box 12L and having a shape vertically long with a narrow breadth in the right and left directions. The accommodation space 30 is formed by notching the front part of the left end of the seat stand 17, specifically notching the part of the left end of the front wall portion 17*a* and the left front part of the support wall portion 17*b* of the seat stand 17.

The side wall portion 31 of the seat stand 17 defines the right end of the accommodation space 30, i.e., the inner end thereof in the right and left directions. Besides, the hydraulic excavator further includes a side cover 32 detachably attached to the seat stand 17, the side cover 32 defining the left end of the accommodation space 30, i.e., the outer end thereof in the right and left directions. The upper part of the accommodation space 30 is closed with the left console box 12L. The lower end of the accommodation space 30 is defined by the floor surface 5*a* formed by the flooring 7.

The side wall portion 31 is formed of a vertical plate member, being interposed between the flooring 7 and the support wall portion 17*b*. The side wall portion 31 includes a first side wall portion 31*a* and a second side wall portion 31*b* integrally. The first side wall portion 31*a* extends rearward from the left end of the front wall portion 17*a* to face the left side, i.e., the outer side in the right and left directions. The second side wall portion 31*b* extends from the rear end of the first side wall portion 31*a* obliquely so as to be displaced rearward with approach to the outer side in the right and left directions (the left side in the embodiment). The outer surface of the second side wall portion 31*b*, i.e., the surface facing the accommodation space 30, corresponds to an oblique guide surface which is laterally oblique relatively to a plane orthogonal to an axis of the turning of the left console box 12L, i.e., the lateral axis J, and guides the curved portion 24*a* as will be described later.

The hydraulic excavator further includes a guide member 35 for guiding and supporting the curved portion 24*a*. The guide member 35 is arch-shaped and attached to the second side wall portion 31*b* to thereby define a reception space for receiving the curved portion 24*a* between the second side wall portion 31*b* and the guide member 35.

Figure 4B:
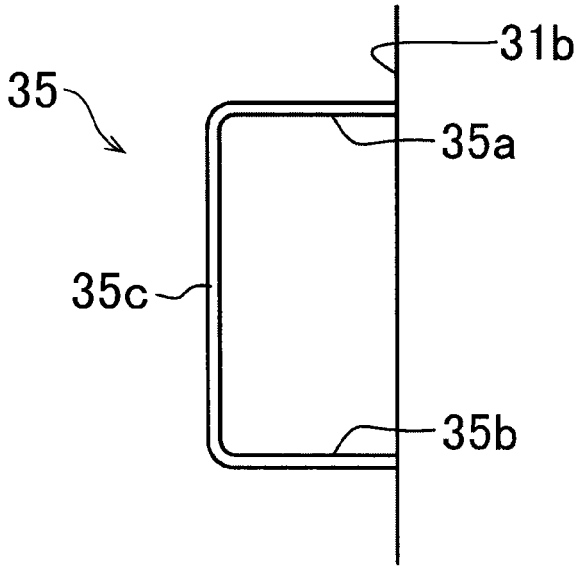
FIG. 4B is a view showing a guide member provided in the hydraulic excavator as viewed along an arrow IXB of FIG. 4A.

Specifically, as shown in FIG. 4B, the guide member 35 integrally has a pair of upper and lower column portions 35*a* and 35*b* and a vertical column portion 35*c*. The upper and lower column portions 35*a* and 35*b* are vertically spaced and fixed to the second side wall portion 31*b* so as to protrude outward (toward the accommodation-space side) from the second side wall portion 31*b*. The vertical column portion 35*c* interconnects respective outer ends of the upper and lower column portions 35*a* and 35*b* while extending vertically, that is, in the direction orthogonal to the upper and lower column portions 35*a* and 35*b*. The guide member 35 can be manufactured, for example, by bending.

The guide member 35 is disposed at a position which allows the guide member 35 to receive the curved portion 24*a* of the group of hydraulic hoses inside the frame formed by the upper and lower column portions 35*a* and 35*b* and the vertical column portion 35*c*. Specifically, the upper and lower column portions 35*a* and 35*b* are fixed to respective vertically middle portions of the second side wall portion 31*b* so as to be vertically aligned. More specifically, the guide member 35 is disposed so as to locate the lower column portion 35*b* under the peak part of the curved portion 24*a*, i.e., the most rearward positioned part of the curved portion 24*a*, and so as to locate the upper column portion 35*a* over the top part thereof.

The flooring 7 defining the lower end of the accommodation space 30 is formed with an insertion hole 36 providing communication of the upper and lower sides of the flooring 7 with each other, and the group of hydraulic hoses is inserted into the insertion hole 36 to pass through the flooring 7. In order to connect the hydraulic equipment accommodated in the device room 6 and the pilot valve 21 to each other, the group of hydraulic hoses includes an under-floor region to be routed under the flooring 7, in addition to the over-floor region. The over-floor region is drawn out over the flooring 7 from the under-floor region through the insertion hole 36.

Figure 5:
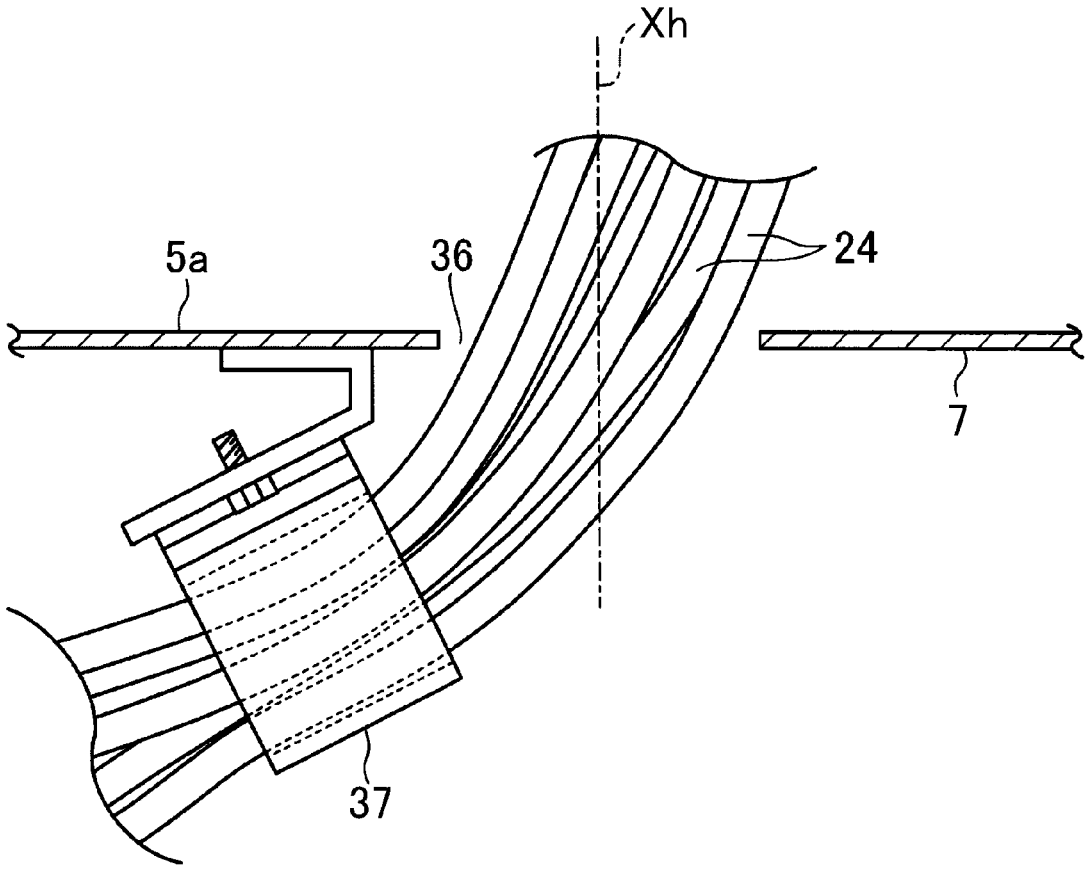
FIG. 5 is a partial cross-sectional side view showing a clamp fixed to a flooring under the operation space and a hydraulic hose held by the clamp.

The hydraulic excavator further includes a clamp 37 shown in FIG. 5. The clamp 37 is fixed to a part of the lower surface of the flooring 7 in the vicinity of the insertion hole 36 to hold the group of hydraulic hoses so as to grip it. Specifically, the group of hydraulic hoses is supported by the clamp 37 in an oblique state relative to an axis Xh of the insertion hole 36 so as to lean rearward the over-floor region of the group of hydraulic hoses, i.e., the region thereof drawn out upward from the insertion hole 36.

In the hydraulic excavator, the outer surface of the second side wall portion 31*b* of the side wall portion 31 in the seat stand 17 functions as the oblique guide surface for protecting the group of hydraulic hoses, particularly the curved portion 24*a*. In the small-sized hydraulic excavator shown here, the device room 6 is positioned immediately rearward of the operation space 5 to compress the rear part of the accommodation space 30 due to the arrangement of equipment. This makes it difficult to avoid the contact of the curved portion 24*a* and the side wall portion 31 with each other when the left console box 12L is shifted to the fall-down position to significantly curve the group of hydraulic hoses. Furthermore, the contact can exert excessive force on the group of hydraulic hoses to thereby bring it into abnormal deformation or reduce durability thereof. For effective reduction in such a burden of the group of hydraulic hoses, the oblique guide surface formed by the outer surface of the second side wall portion 31*b*, that is, the surface being oblique so as to be displaced rearward with approach to the outer side in the right and left directions, i.e., the left side in the embodiment, plays a role of shifting the curved portion 24*a* laterally.

More specifically, although the rearward curvature of the curved portion 24*a*, which is a vertically middle part of the group of hydraulic hoses, is increased with the turning of the left console box 12L from the upturn position to the fall-down position to thereby bring the curved portion 24*a* into contact with the outer surface of the second side wall portion 31*b*, the outer surface, being oblique so as to be displaced rearward with approach to the outer side in the right and left directions, can guide the curved portion 24*a* so as to make the curved portion 24*a* slide laterally along the outer surface by the turning of the console box 12L, that is, can shift the middle portion of the group of hydraulic hoses laterally leftward so as to allow the curved portion 24*a* slide laterally while keeping vertically curved. This guide effectively reduces the burden due to the contact of the group of hydraulic hoses with the side wall portion 31 while hardly hindering the group of hydraulic hoses from curving movement.

In addition, the guide member 35 assists the group of hydraulic hoses in the smooth movement. Specifically, the guide member 35 receives the curved portion 24*a* of the group of hydraulic hoses sliding along the outer surface of the second side wall portion 31*b*, into the reception space between the guide member 35 and the outer surface of the second side wall portion 31*b*, to guide the curved portion 24*a* while supporting it, thereby suppressing flapping of the group of hydraulic hoses to stabilize the sliding movement thereof.

Besides, the clamp 37 also contributes to the stable sliding movement of the group of hydraulic hoses. Specifically, the clamp 37, holding the under-floor region of the group of hydraulic hoses so as to lean the over-floor region of the group of hydraulic hoses rearward, can direct the curvature of the group of hydraulic hoses rearward to thereby enable the curved portion 24*a* of the over-floor region to come into stable contact with the second side wall portion 31*b*. Furthermore, the clamp 37 makes the under-floor region extend obliquely downward from the insertion hole 36 of the flooring 7 to thereby decrease the protrusion of the under-floor region beyond the flooring 7, which eliminates necessity for excessively curving the group of hydraulic hoses. This facilitates routing of the group of hydraulic hoses along the flooring 7 under the floor.

The working machine according to the present invention is not limited to the above-described embodiment but permitted to include other various modes, e.g., the following modes.

The guide member according to the present invention may also be semicircular. The shape of the guide member only has to be a shape capable of guiding the curved portion of the group of hydraulic hoses while supporting it, hence not limited to the shape of the arch. Specifically, as the guide member, may be used a guide member having a shape similar to the guide member 35A shown in FIG. 7A wherein the upper column portion 35*a* thereof is omitted while only the lower column portion 35*b* and the vertical column portion 35*c* extending upward from the outer end thereof remains, that is, an L-shaped member having an opened upper end. Alternatively, there may also be used a guide member 35B shown in FIG. 7B, which protrudes from the second side wall portion 31*b* while being curved upward to have an opened upper end. Although not shown in the drawing, only a straight bar capable of receiving the lower part of the group of hydraulic hoses is also permitted to constitute the guide member. Moreover, the guide member is not limited to the bar but permitted to be a plate member or resin molded products having other shapes.

The oblique guide surface is not limited to a flat surface but permitted to be a curved surface. The specific obliqueness of the oblique guide surface can be appropriately determined in accordance with specifications. The number of hydraulic hoses 24 is also free from limitation.

The console box as the essential element of the present invention is not limited to the left console box 12L. In the case of locating the entrance on the right side, the right console box 12R corresponds to the element of the present invention. In addition, the working machine according to the present invention may also be one including only a single console box. The present invention is, thus, permitted to be applied to a working machine including at least one console box capable of being turned so as to open and close the entrance.

As described above, according to the present invention, there is provided a working machine including a so-called upturn type of console box and a hydraulic hose connected to the console box, the working machine being capable of effectively preventing excessive force from being exerted on the hydraulic hose involved by the movement of the console box, within a space limitation. The provided working machine comprises: a base carrier; a machine body mounted on the base carrier, the machine body including a working device configured to make a working movement according to an operation, a device room accommodating a device for hydraulic control of the working device, a flooring forming a floor surface, and an operation space defined on the floor surface to allow the operation on the working device to be performed in the operation space; a seat stand provided in the operation space and including a side wall portion defining a hose accommodation space; an operator's seat supported by the seat stand at a position higher than the floor surface; a console box supported by the seat stand at a position higher than the floor surface and alongside the operator's seat, the console box having a rear part coupled to the seat stand so as to be capable of being turned to allow the console box to be moved between a fall-down position at which the console box blocks an entrance route lateral to the operator's seat and an upturn position at which a front part of the console box is upturned so as to open the entrance route; and a hydraulic hose including an over-floor region which extends upward from the floor surface to be connected to the front part of the console box, the over-floor region of the hydraulic hose being accommodated in the hose accommodation space so as to be rearward curved with a curvature which is increased with a movement of the console box from the fall-down position to the upturn position. The side wall portion of the seat stand has an oblique guide surface which is laterally oblique relatively to a plane orthogonal to an axis of the turning of the console box, and the oblique guide surface guides a curved portion of the over-floor region of the hydraulic hose so as to make the curved portion slide laterally along the oblique guide surface by the turning of the console box.

According to the working machine, the hydraulic hose extending upward from the flooring and connected to the console box is accommodated in the hose accommodation space provided in the seat stand, and the side wall portion defining the hose accommodation space provides the oblique guide surface capable of receiving the curved portion of the hydraulic hose and causing the curved portion thereof to slide laterally. The oblique guide surface, thus, can shift the curved portion, i.e., the portion of the hydraulic hose whose rearward curvature is increased with the movement of the console box from the upturn position to the fall-down position, so as to make the curved portion slide laterally, thereby allowing the burden of the hydraulic hose due to the contact with the side wall portion to be effectively reduced while hardly hindering the hydraulic hose from vertical curving movement.

The working machine according to the present invention, preferably, further comprises a guide member protruding from the oblique guide surface and including a portion located under the curved portion sliding along the oblique guide surface to guide the curved portion while supporting the curved portion. The guide member can suppress flapping of the hydraulic hose sliding along the oblique guide surface to stabilize the movement of the hydraulic hose.

The guide member is, preferably, shaped as, e.g., an arch defining a reception space to receive the curved portion of the hydraulic hose and supports the curved portion while allowing the curved portion received in the reception space to slide. The thus shaped guide member can support the curved portion of the hydraulic hose more stably, thereby further effectively suppressing the flapping of the hydraulic hose.

In the case where the hydraulic hose includes an under-floor region routed under the flooring and between the device room and the operation space, in addition to the over-floor region drawn out over the flooring from the under-floor region through an insertion hole formed in the flooring, it is preferable that the working machine according to the present invention further includes a clamp which is fixed to the flooring in the vicinity of the insertion hole to hold the hydraulic hose so as to lean the over-floor region rearward. The clamp directs the curvature of the over-floor region rearward to thereby allow the curved portion of the over-floor region to make stable contact with the oblique guide surface and facilitate routing of the under-floor region.

This application is based on Japanese Patent application No. 2013-225403 filed in Japan Patent Office on Oct. 30, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A working machine comprising:

a base carrier;

a machine body mounted on the base carrier, the machine body including a working device configured to make a working movement according to an operation, a device room accommodating a device for hydraulic control of the working device, a flooring forming a floor surface, and an operation space defined on the floor surface to allow the operation on the working device to be performed in the operation space;

a seat stand provided in the operation space and including a side wall portion defining a hose accommodation space;

an operator's seat supported by e seat stand at a position higher than the floor surface;

a console box supported by the seat stand at a position higher than the floor surface and alongside the operator's seat, the console box having a rear part coupled to the seat stand so as to be capable of being turned to allow the console box to be moved between a fall-down position at which the console box blocks an entrance route lateral to the operator's seat and an upturn position at which a front part of the console box is upturned so as to open the entrance route; and a hydraulic hose including an over-floor region which extends upward from the floor surface to be connected to the front part of the console box, the over-floor region being accommodated in the hose accommodation space so as to have a curved portion rearward curved with a curvature which is increased with a movement of the console box from the upturn position to the fall-down position, wherein:

the side wall portion of the seat stand has an oblique guide surface which is laterally oblique relatively to a plane orthogonal to an axis of the turning of the console box; and the oblique guide surface guides the curved portion of the over-floor region of the hydraulic hose so as to make the curved portion slide laterally along the oblique guide surface by the turning of the console box.

2. The working machine according to claim 1, further comprising a guide member protruding from the oblique guide surface, wherein the guide member includes a portion located under the curved portion sliding along the oblique guide surface, the portion of the guide member guides the curved portion while supporting the curved portion.

3. The working machine according to claim 2, wherein the guide member is shaped as an arch defining a reception space to receive the curved portion of the hydraulic hose and supports the curved portion while allowing the curved portion received in the reception space to slide.

4. The working machine according to claim 1, further comprising a clamp for holding the hydraulic hose, wherein:

the hydraulic hose further includes an under-floor region routed under the flooring and between the device room and the operation space;

the over-floor region is drawn out over the flooring from the under-floor region through an insertion hole formed in the flooring; and the clamp is fixed to the flooring in the vicinity of the insertion hole to hold the hydraulic hose so as to lean the over-floor region rearward.

* * * * *